US005454420A

United States Patent [19]

Snider et al.

[11] Patent Number: 5,454,420

[45] Date of Patent: Oct. 3, 1995

[54] METHOD AND APPARATUS FOR ROTATING DOWNHOLE TOOL IN WELLBORE

[75] Inventors: Philip M. Snider, Houston; Michael J. Dietrich, Katy, both of Tex.

[73] Assignee: Marathon Oil Company, Findlay, Ohio

[21] Appl. No.: 961,101

[22] Filed: Oct. 14, 1992

[51] Int. Cl.[6] ..... E21B 23/00

[52] U.S. Cl. ..... 166/381; 166/117.5; 175/85; 175/322

[58] Field of Search ..... 166/117.7, 53, 166/104, 381, 374; 175/40, 45, 26, 85, 322

[56] References Cited

U.S. PATENT DOCUMENTS

| | | | |
|---|---|---|---|
| 444,839 | 1/1891 | Logan | 175/322 |
| 565,442 | 8/1896 | Durnell | 175/322 |
| 893,079 | 7/1908 | Kramer et al. . | |
| 1,071,499 | 8/1913 | Baker | 175/322 |
| 1,110,639 | 9/1914 | Moore . | |
| 1,318,225 | 10/1919 | Nippert . | |
| 1,612,889 | 1/1927 | Smith | 175/322 |
| 1,641,206 | 9/1927 | Smith | 175/322 |
| 1,647,961 | 11/1927 | Dougherty | 175/322 |
| 1,756,128 | 4/1930 | Monroe . | |
| 1,785,086 | 12/1930 | Hauk | 175/322 |
| 1,817,067 | 8/1931 | Crowell | 175/322 |
| 1,900,932 | 3/1933 | Hollestelle | 175/322 |
| 2,719,024 | 9/1955 | Prescott et al. | 166/104 |
| 2,728,556 | 12/1955 | House | 255/14 |
| 2,947,520 | 8/1960 | Tappmeyer | 166/117.7 |
| 2,947,521 | 8/1960 | Tappmeyer | 255/35 |
| 4,007,797 | 2/1977 | Jeter | 175/26 |
| 4,015,662 | 4/1977 | Cochran | 166/104 |
| 4,270,620 | 6/1981 | Lawrence | 175/322 |
| 4,553,590 | 11/1985 | Phillips | 166/53 |

FOREIGN PATENT DOCUMENTS

| | | |
|---|---|---|
| 2461089 | 7/1979 | France . |
| 2603940A1 | 9/1986 | France . |

*Primary Examiner*—Ramon S. Britts
*Assistant Examiner*—Frank S. Tsay
*Attorney, Agent, or Firm*—Jack L. Hummel; Jack E. Ebel

[57] ABSTRACT

A wellbore operation in which a downhole tool is given rotary motion without rotating the tubing string to which it is attached. A "Yankee screwdriver" type of connecting element is used to connect a downhole tool to a tubing string so that compressive forces acting on the connector as a result of relative linear movement between the connector and the tool cause the tool to rotate. A number of various types of downhole operations are possible, such as rotating a tool away from an obstruction and retrieving the upper section of a lost tubing string.

24 Claims, 3 Drawing Sheets

METHOD AND APPARATUS FOR ROTATING DOWNHOLE TOOL IN WELLBORE

FIELD OF THE INVENTION

This invention relates to the operation of downhole tools in a wellbore. More particularly, it relates to a method of causing a downhole tool to avoid obstructions or to perform rotational operations in a wellbore in a manner which does not require rotation of the tubing string to which the tool is connected.

BACKGROUND OF THE INVENTION

In the operation of many downhole tools employed in oilfield wellbores it is necessary to rotate the tools. For example, when a downhole tool encounters an obstruction which prevents further downward movement of the tubing string and tool, the tool can often be cleared from the obstruction by rotating it. Rotation is also performed for other purposes, such as aligning a tool with a bore in a packer seal.

Rotation of a downhole tool is normally carried out by rotating the tubing string to which the tool is attached. This is not a viable method, however, in all cases. For example, rotation of a downhole tool connected to the longer tubing string of a dual string arrangement is extremely difficult, and sometimes impossible, to carry out by this method due to the tendency of the strings to twist around each other when surface rotation is applied to both strings. Nor is rotation possible when the tool is connected to coil tubing or to a wireline. Prior to this invention, no practical solution to these problems has been available.

Another problem involves the retrieval of drill pipes which become stuck or lost when drilling a well. Conventionally, a threaded tool on the end of a tubing string is used to "fish" for the lost drilling sections. The tool is aligned with the upper end of the lost pipe, attached to it, then rotated in a direction to unthread the attached section from the other lost pipe sections. When left-hand torque is applied to the tubing string at the surface, there is considerable risk that the torque might loosen one of the threaded joints in the tubing string before the lost pipe section is loosened, resulting in lost time and expense in retrieving the separated tubing string as well as the lost pipe sections.

One suggested way of imparting rotary movement to a downhole tool for the purpose of screwing or unscrewing sections of a well casing or tubing string is by use of a so-called "Yankee screwdriver". Such structure utilizes a helical connection between two elements which imparts rotary motion to one of the elements upon relative linear motion between the elements. Normally, the tubing string is provided with means for gripping the casing in which it is located to prevent rotation of the string. Such an arrangement, however, involves a more complicated and expensive structure than is desirable and is not suited to a rapid retrieval operation.

It would be desirable to be able to impart rotational motion to a downhole tool in a simple, inexpensive manner without requiring rotation of the tubing string to which it is connected in order to carry out various operations, such as those mentioned above.

BRIEF SUMMARY OF THE INVENTION

To achieve the foregoing and other objects, and in accordance with the purposes of the present invention, as embodied and broadly described herein, one characterization of the present invention comprises a method of rotating a downhole tool in contact with an obstruction in a wellbore. According to the disclosed method, a connecting element is rigidly attached to the end of a tubing string in a manner that prevents the connecting element from rotating relative to the tubing string. An axially directed force is applied to the tubing string, thereby causing the connecting element to contact and attach to the tool via a helical connecting means. Continued application of the axially directed force to the tubing string, connecting element, and tool causes the tool to rotate in a helical path relative to the connecting element and the tubing string, with the helical path centered axially about the longitudinal axis of the tubing string upon application to the tool of an axially directed force. If the tubing string meets an obstruction during its downward movement in the wellbore, continued downward pressure on the tubing string causes sufficient compressive force to be exerted on the tool to cause the connecting means to rotate the tool relative to the tubing string. Similarly, if the tool meets an obstruction during upward movement in the wellbore, continued upward pressure on the tubing string causes sufficient tensile forces to be exerted on the tool to cause the connecting means to rotate the tool relative to the tubing string. Rotation of the tool results in the tool being newly oriented with respect to the obstruction, enabling the tool to move past the obstruction. If the obstacle is a portion of a packer adjacent a bore in the packer, rotation of the tool enables the tool and tubing string to enter the bore. Examples of tubing strings with which the connecting means of the invention is most beneficially employed are coil tubing, wirelines. Another example is dual tubing strings of different lengths extending through a dual packer, where the connecting means is attached to the longer tubing string. Since the linear or axial force exerted upon the connecting element by the axial pressure resulting from contact with an obstruction is sufficient to cause rotation of the tool, it is not necessary to provide means for preventing rotation of the tubing string during this rotary movement of the tool.

Where the obstacle encountered is the upper end of a tubing section to be retrieved, the downhole tool is adapted to attach itself to the upper end and to be rotated in a direction to loosen the threaded connection between the section to be retrieved and the next lower section.

Another characterization of the present invention is an apparatus for moving a downhole tool away from an obstruction in a wellbore when the tool is in contact with the obstruction. The apparatus comprises a tubing string mounted in the wellbore so that the tubing is capable of being deflected from its longitudinal axis. The apparatus also comprises a means for rigidly connecting the tool to the tubing string and a structure on or in the tool which is capable of mating with the connecting means so that application of an axially directed force to the tool causes the tool to rotate on a helical path centered axially about the longitudinal axis of the tubing string and connecting means.

Because the connecting element has no internal moving parts, the invention provides a simple, reliable, economical way of causing a downhole tool to rotate in order to effect a variety of beneficial results, including a great reduction in downtime which might normally be required as a result of difficulties encountered in attempting to rotate a tubing string which carries a downhole tool. These and other features and aspects of the invention, as well as its various benefits, will be made more clear in the detailed description of the invention which follows.

DETAILED DESCRIPTION OF THE PREFERRED EMBODIMENTS

Figures 1, 2, 2A, 3:
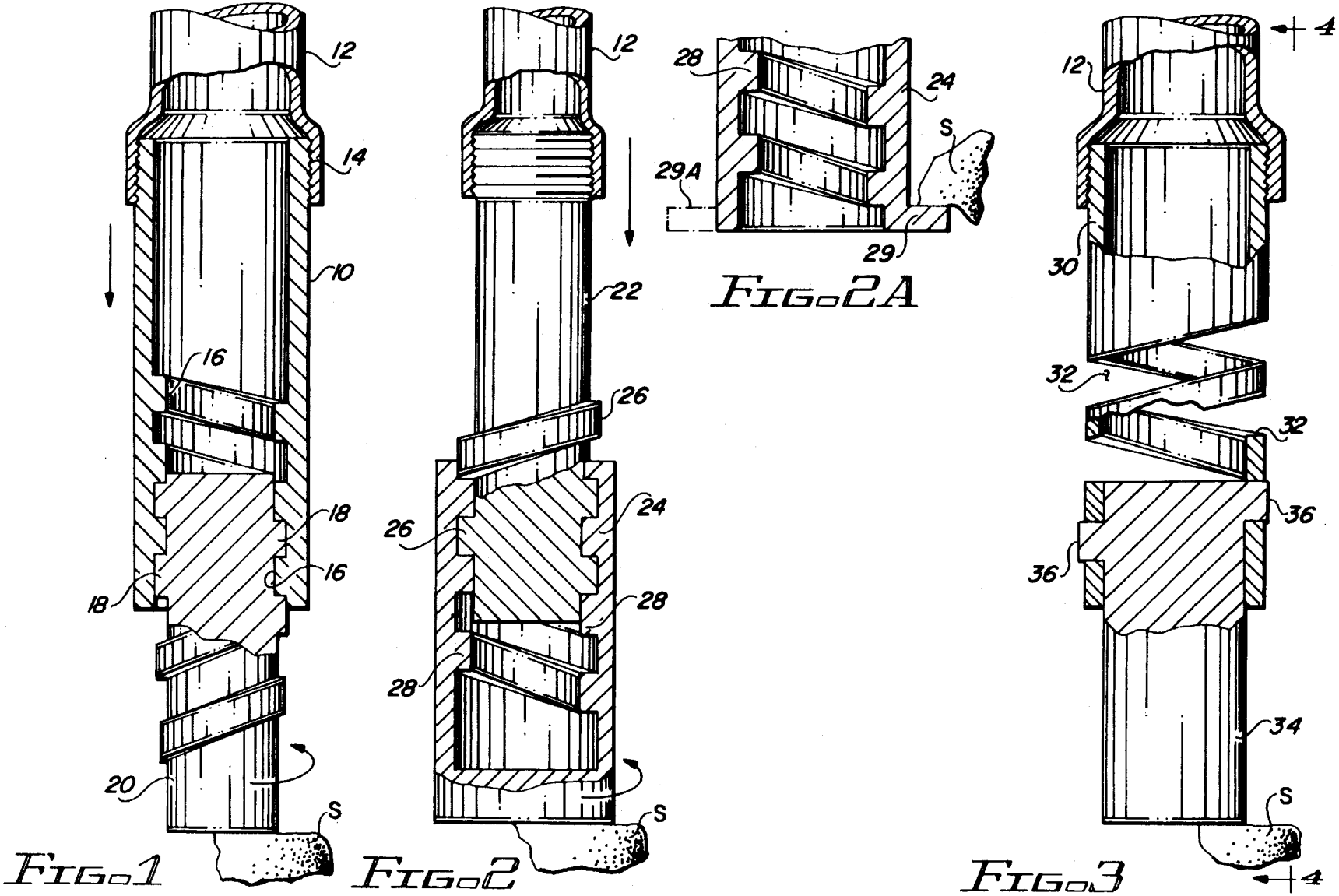
FIG. 1 is an enlarged partial longitudinal sectional view of a downhole tool connected to a tubing string by a connecting element capable of converting linear motion to rotary motion.
FIG. 2 is a partial longitudinal sectional view similar to that of FIG. 1, but showing a modified connecting element arrangement.
FIG. 2A is a partial longitudinal sectional view of the bottom portion of a connector similar to that of FIG. 2, but showing the connecting element as being designed to impart rotary motion upon being placed in tension instead of compression.
FIG. 3 is a partial longitudinal sectional view of a further modified connecting element arrangement.

Referring to FIG. 1, which shows an example of a "Yankee screwdriver" type of connecting element for use in the present invention, a sleeve 10 is attached at its upper end to the lower end of a tubing string 12 by screw threads 14. The lower portion of the inner surface of the sleeve is provided with female a helical land or screw thread 16. Engaging the groove or passageway between adjacent lands 16 is a complementary male land or thread 18 carried on the cylindrical upper portion of a downhole tool 20, which for the purpose of this description may be any of a variety of available tools. The lower end of the tool is illustrated as being in contact with an obstruction or immovable surface S. It can be seen that by applying a force along the tubing string axis, the sleeve will be moved closer to the surface S, and the engagement of the threads 18 with the passageway between the threads 16 will cause the tool 20 to rotate as it moves up into the sleeve. Thus the tool is made to rotate about the longitudinal axis of the tubing string without requiring the tubing string or the sleeve to be rotated.

The same result can be obtained by making the tool in the shape of a female threaded sleeve and the connecting element in the shape of a cylinder. This is illustrated in FIG. 2, wherein the connecting element 22 extends through the open upper end of the sleeve-shaped tool 24. The outer surface of the connecting element 22 carries a male helical thread 26 which engages the passageway between the helical thread 28 on the inner surface of the upper cylindrical portion of the tool 24. As in the arrangement of FIG. 1, an axial compressive force exerted against the connecting element 22 causes the tool 24 to rotate as a result of relative linear motion between the tool 24 and the connecting element 22.

The disclosed invention makes it possible to rotate the tool in situations where it is impossible or undesirable to rotate the entire tubing string from the surface. The connecting element need not be limited to converting an axial compressive force to rotary motion, but may be designed to function in response to an axial tensile force as well. As shown in FIG. 2A, the lower portion of the tool 24 is provided with a lip or flange 29 which engages an obstruction S as the tool is being pulled up. The resulting tensile forces cause the tool 24 to rotate as a result of the relative linear motion between the tool 24 and the connector 22. It will be understood that one or more additional flanges 29A may be provided instead of a single flange, or that an annular flange may be used if appropriate.

Figure 4:
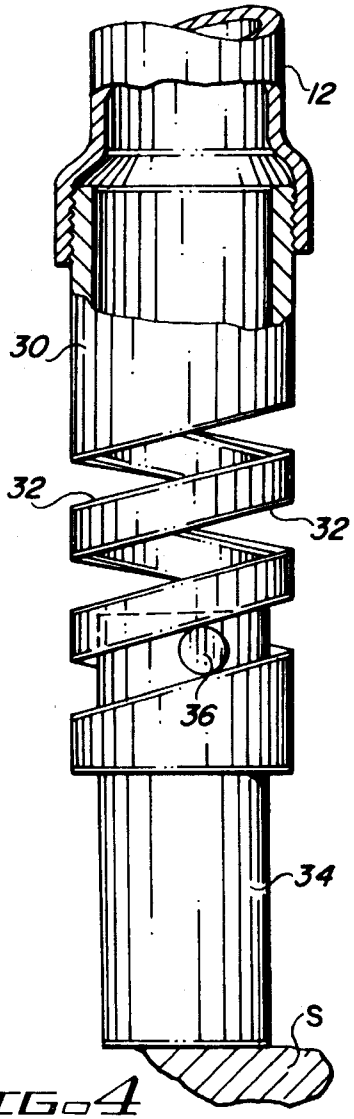
FIG. 4 is a partial side elevation of the connecting element arrangement shown in FIG. 3, with the upper portion of the view shown in section.

Other connecting element designs may be used as long as they are capable of transforming linear motion to rotary motion. For example, in FIGS. 3 and 4 the sleeve 30 is provided with a helical slot 32 and the cylindrical tool 34 is provided with one or more projections 36 which extend through the slot. As in the arrangements described above, when linear motion of the tubing string places the connector 30 in compression as a result of the tool encountering an obstacle S, the compressive force of the connector slot 32 against the projections 36 of the tool will cause the tool to rotate. Obviously, in this as well as other connector designs, the direction of the helical member may be such as to cause the tool to have either right-hand or left-hand rotation. Also, as discussed above, the design can readily be changed to function as a result of placing the tool in tension instead of compression.

Figure 6:
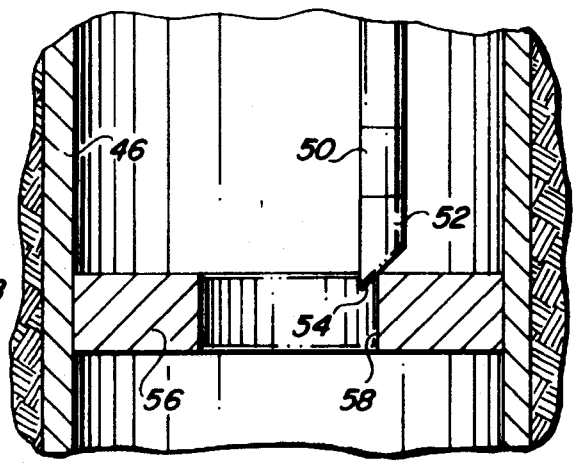
FIG. 6 is a partial longitudinal sectional view of a portion of the structure of FIG. 5, showing the tool after it has been rotated.
Figure 5:
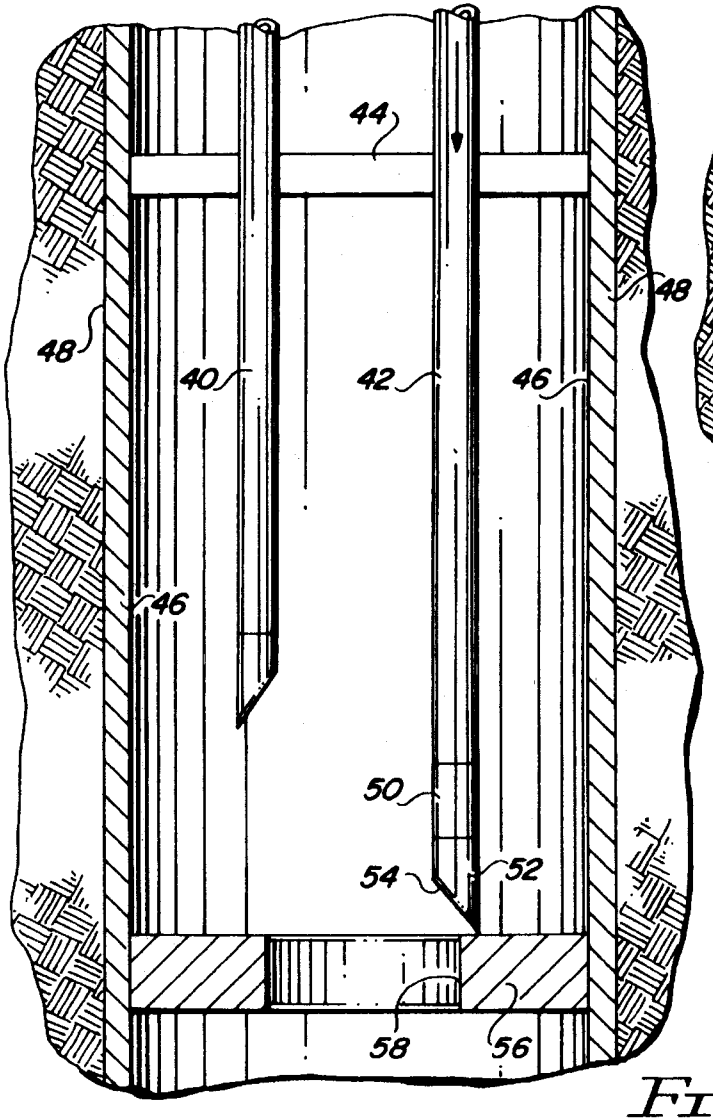
FIG. 5 is a partial longitudinal sectional view of a well bore in which the invention is employed in connection with a dual tubing string.

Referring now to FIG. 5, a pair of tubing strings 40 and 42 are shown extending through bores in a dual bore packer 44 located within the casing 46 of a wellbore 48. The longer tubing string 42 is connected to connector 50 which in turn is connected to downhole tool 52. Any desirable connector design may be used, such as one of the arrangements described above, as long as it is capable of transforming linear motion of the tubing string and connector to rotary motion of the tool. The tool is shown as having a sloped lower surface 54 to guide the tool away from an obstruction, in the manner of a so-called "mule shoe". As illustrated, the point of the tool has struck the upper face of a packer 56 containing a central bore 58 through which it is desired to move the string 42. It can be seen that the lower surface 54 of the tool must be rotated to the position shown in FIG. 6 to engage the upper face of the packer 56. If it were attempted to accomplish this by rotating the dual tubing strings 40 and 42 from the surface, the strings would tend to twist around each other, causing the operation to be discontinued until the tubing strings are restored to their proper condition. By employing the method of the invention, however, the compressive force of the tubing string pushing against the tool as it makes initial contact with the packer causes the connector to rotate the tool from the position of FIG. 5 to the position of FIG. 6. The slightly lower position of the tool in FIG. 6 compared to FIG. 5 results from the continued downward pressure exerted by the lowering of the tubing string as the sloped bottom surface of the tool slides the tubing string into the packer bore.

Figures 7, 8, 9, 10:
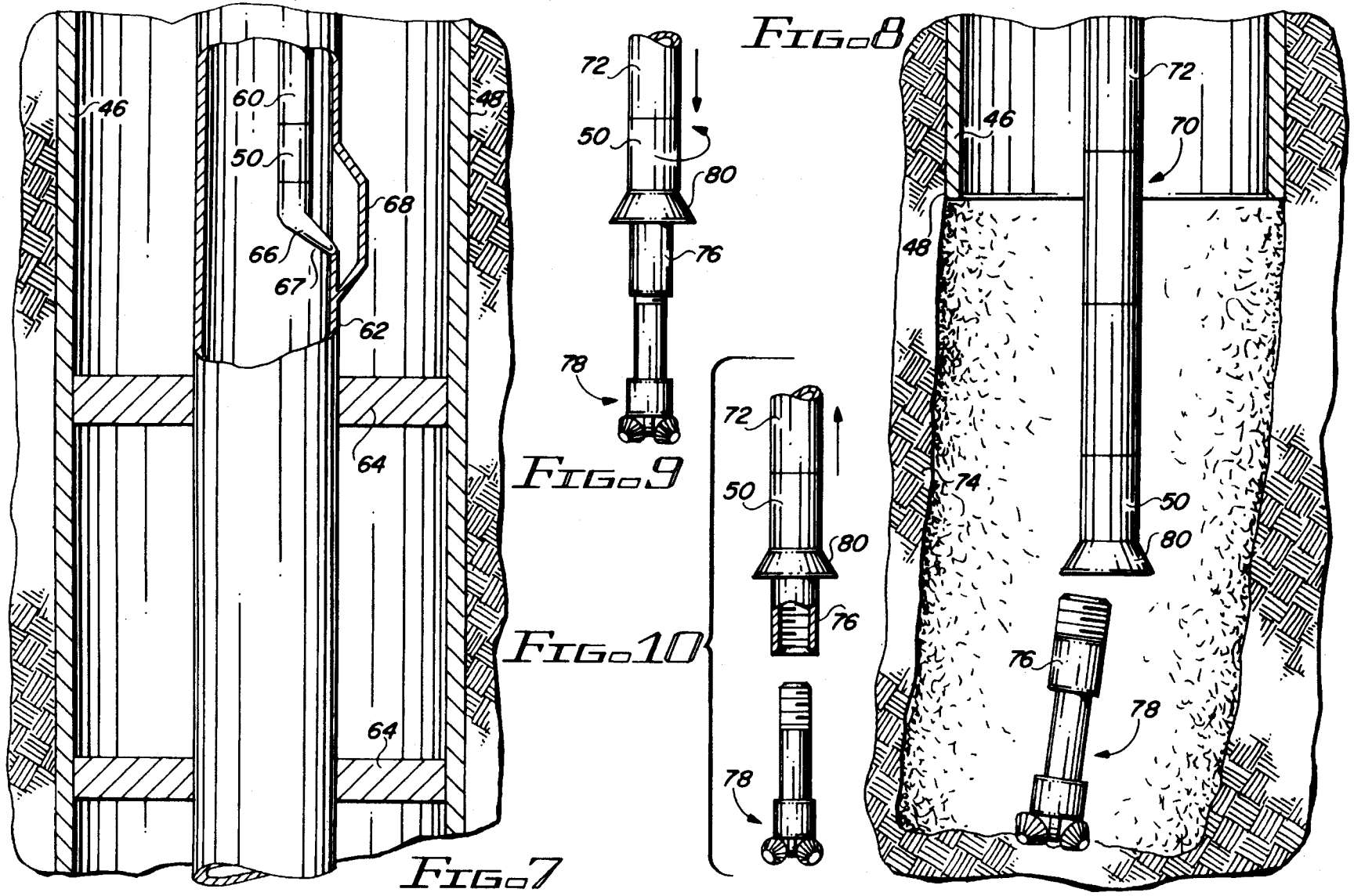
FIG. 7 is a partial longitudinal sectional view of a well bore in which the invention is employed in connection with coil tubing.
FIG. 8 is a partial longitudinal sectional view of a well bore in which the invention is employed in fishing for lost drill pipe.
FIG. 9 is a schematic representation of the fishing tool of FIG. 8 after being attached to a drill section to be retrieved.
FIG. 10 is a schematic representation of the fishing tool of FIG. 8 after loosening and separating the drill section.

Another use of the invention is illustrated in FIG. 7, wherein coil tubing 60 is being lowered through tubing 62 which extends through central bores in packers 64 mounted in the well casing 46. The tool 66 has a sloped lower surface 67, as in the case of the tool discussed in connection with FIGS. 5 and 6, and is shown as having contacted the upper edge of part of a gas lift mandrel 68. This is a typical area where coil tubing becomes snagged or obstructed. Since the coil tubing 60 at the surface is in coil form, rotation of the coil tubing at the surface in order to divert the tool from the obstruction is impossible. According to the invention, similar to the arrangement of FIGS. 5 and 6, a connecting element 50 connects the tool 66 to the coil tubing 60 and converts linear compressive forces created by contact with the gas lift mandrel to rotary motion of the tool. The tool is thus caused to rotate out of engagement with the obstruction, allowing the coil tubing to continue passage through the tube 62. Although not specifically illustrated, it will be understood that the invention would be similarly useful in connection with any flexible means for supporting a downhole tool which is incapable of being rotated at the surface, such as, for example, a wire line.

Another use of the invention is illustrated in FIG. 8, which depicts a fishing operation. In this case a tubing string 70 comprised of a number of tubing sections 72 secured together by screw threads has been lowered down through the casing 46 of wellbore 48 into the uncased open hole 74, in an attempt to locate and retrieve lost sections 76 of a drill string 78. In virtually all cases, the sections 76 are connected together by screw threads which are tightened by right-hand rotation, as are the sections of the tubing string 70. A downhole tool 80 is attached to a connector 50 designed to impart left-hand rotation to the tool, and the bottom portion of the downhole tool, known in the field as an overshot, is designed to securely grip the "fish" or top of the uppermost section 76, when lowered onto it. This latter arrangement is well known in the industry and therefore has not been illustrated in detail.

After the tool is connected to the uppermost section 76, as schematically illustrated in FIG. 9, a arm dual compressive force is applied to the tubing string, which causes the connector 50 to impart left-hand rotation to the tool 80 to loosen the uppermost section 76 from the next lower section. The tubing string is then raised, as illustrated in FIG. 10, lifting with it the attached section 76 which has been removed from the rest of the lost drill string.

When an axial force is given to the tubing string of sufficient magnitude to transform the linear forces involved into rotary forces, whether by a design requiring compressive forces or tension forces, reactive forces in the tubing string above the Yankee screwdriver connector cause the string to tend to rotate in the opposite direction. Thus when the connector rotates the tool so as to loosen the upper section 76 from its threaded connection to the next lower section, the tubing sections 72 tend to rotate in the opposite direction and are actually tightened as a result. There is no danger, therefore, of the tubing string sections separating as they tend to do in the usual type of fishing operation where the tubing string has to be rotated to the left in order to loosen the upper section from the rest of the lost drill string.

It will now be appreciated that the present invention provides a unique use for a Yankee screwdriver type of motion converter connecting element. The tubing string to which the connector is attached does not have to be restrained against rotary motion while the tubing string is given a downward force, and is thus capable of being deflected from the axis of the tubing string. The methods described make it unnecessary to rotate the entire tubing string in order to rotate a downhole tool away from an obstruction or to perform other downhole operations. Obviously, the type of tool attached to the connector may vary depending on the operation to be performed.

It should also be clear that although preferred embodiments of the invention have been described, it is possible to make changes to certain specific details of the preferred embodiments without departing from the spirit and scope of the invention, as defined in the appended claims.

What is claimed is:

1. A method of rotating a downhole tool in contact with an obstruction in a wellbore, the method comprising:

rigidly attaching a connecting element to the end of a tubing string such that the connecting element cannot move relative to the tubing string;

applying an axially directed force to the tubing string, thereby causing the connecting element to contact the tool and the tool to attach to the connecting element via a helical connecting means which is secured against movement with respect to said connecting element; and continuing to apply the axially directed force to the tubing string, connecting element, and tool, thereby causing the tool to rotate about the longitudinal axis of the tubing string while simultaneously moving along the axis of the tubing string.

2. The method of claim 1 wherein the helical connecting means comprises a projection on either the tool or the connecting element engaging a helical passageway in the other of the tool or connecting element.

3. The method of claim 1 wherein the tubing string is capable of being deflected from its longitudinal axis.

4. The method of claim 1 wherein rotation of the tool relative to the tubing string enables the tool to move past the obstruction.

5. The method of claim 4, wherein the tubing string comprises coil tubing.

6. The method of claim 4, wherein the tubing string comprises a wire line.

7. The method of claim 1, wherein the obstruction is the upper section of a drill string, said upper section being connected to the next lower section of said drill string by screw threads of either right-hand or left-hand configuration, the tubing string being comprised of tubular sections connected to each other by screw threads of the same right-handed or left-handed direction as the threads of the drill string, and the downhole tool having a lower portion adapted to be attached to the upper section of the drill string, the connecting means causing rotation of the tool in a direction to loosen the threaded connection of the upper section thereby permitting retrieval of the upper section of said drill string.

8. The method of claim 1, wherein said tool is attached to said connecting element prior to contacting said obstruction in said wellbore.

9. The method of claim 8, wherein said tubing string is a dual tubing string having tubing of different lengths extending through a dual packer; said connecting element is attached to the end of the longer tubing string beyond the dual packer; said obstruction is a portion of a second packer adjacent a bore in the second packer; and said rotation of said tool enables the tool, connecting element, and tubing string to enter the bore.

10. The method of claim 1, wherein said axially directed force which is applied to said tool and said connecting element is a compressive force which causes said tool to rotate relative to said connecting element and said tubing string.

11. The method of claim 1, wherein said axially directed force which is applied to said tool and said connecting element is a tensile force which causes said tool to rotate relative to said connecting element and tubing string.

12. The method of claim 1 wherein said tubing string comprises tubular sections connected to each other by all right-handed or all left-handed screw threads, said obstruction is a multiple-jointed pipe, the joints of the pipe are connected with either all right-handed or all left-handed screw threads, said downhole tool has a lower portion adapted for attachment to the end of the pipe, and the application of said axially directed force causes said tool to rotate in a direction to separate one or more pipe joints from the remaining joint or joints.

13. An apparatus for moving a downhole tool away from an obstruction in a wellbore with which the tool is in contact, the apparatus comprising:

a tubing string mounted in the wellbore so that the tubing string is capable of being deflected from its longitudinal axis;

means for connecting the tool to the tubing string, the connecting means being rigidly attached to the tubing string such that the connecting means cannot move relative to the tubing string; and means for rotating the tool on a helical path centered axially about the axis of the tubing string and connecting means upon application of an axially directed force to the tool, said connecting means and Said rotating means being secured against relative movement.

14. The apparatus of claim 13 wherein the helical means comprises a projection on either the tool or the connecting means, the projection engaging a helical passageway in the other of the tool or connecting means.

15. The apparatus of claim 14, wherein the connecting means is shaped as a sleeve and the downhole tool is cylindrical.

16. The apparatus of claim 14, wherein the downhole tool is shaded as a sleeve and the connecting means is cylindrical.

17. The apparatus of claim 13 wherein the connecting means causes relative rotary motion between the tool and the tubing string as a result of continued compressive force being applied to the tool after the tool meets an obstruction to movement further into the well.

18. The apparatus of claim 13 wherein the connecting means causes relative rotary motion between the tool and the tubing string as a result of continued tensile force being applied to the tool after the tool meets an obstruction to movement further out of the well.

19. The apparatus of claim 13, wherein said structure capable of mating with said connecting means is a male threaded helix.

20. The apparatus of claim 13, wherein said structure capable of mating with said connecting means is a female threaded helix.

21. The apparatus of claim 13, wherein said connecting means includes a male threaded helix.

22. The apparatus of claim 13, wherein said connecting means includes a female threaded helix.

23. The apparatus of claim 14, wherein said connecting means is tubular in shape and forms a male portion of the connection with said tool.

24. The apparatus of claim 14, wherein at least a portion of said tool is tubular in shape and forms a male portion of the connection with said connecting means.

* * * * *

UNITED STATES PATENT AND TRADEMARK OFFICE

CERTIFICATE OF CORRECTION

PATENT NO. : 5,454,420

DATED : October 3, 1995

INVENTOR(S) : Philip M. Snider and Michael J. Dietrich

It is certified that error appears in the above-indentified patent and that said Letters Patent is hereby corrected as shown below:

Col. 2, Lines 18-28: Delete "upon application to the tool of an axially directed force. If the tubing string meets an obstruction during its downward movement in the wellbore, continued downward pressure on the tubing string causes sufficient compressive force to be exerted on the tool to cause the connecting means to rotate the tool relative to the tubing string. Similarly, if the tool meets an obstruction during upward movement in the wellbore, continued upward pressure on the tubing string causes sufficient tensile forces to be exerted on the tool to cause the connecting means to rotate the tool relative to the tubing string."

Col. 4, Line 45: Delete "dual bore".

Col. 5, Line 46: Delete "a arm dual" and insert --an axial--.

Col. 7, Line 36: Delete "Said" and insert --said--.

Col. 8, Line 8 : Delete "shaded" and insert --shaped--.

Signed and Sealed this

Eighteenth Day of June, 1996

Bruce Lehman

*Attest:*

BRUCE LEHMAN

*Attesting Officer*

*Commissioner of Patents and Trademarks*